US006405789B1

(12) United States Patent
Zakel

(10) Patent No.: US 6,405,789 B1
(45) Date of Patent: Jun. 18, 2002

(54) COMBINED BASKET REMOVAL DOOR AND PLATFORM FOR AIR PREHEATERS

(75) Inventor: Michael Zakel, Wellsville, NY (US)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/852,478

(22) Filed: May 10, 2001

(51) Int. Cl.[7] ..... F28F 7/00
(52) U.S. Cl. ..... 165/77; 165/8; 165/10
(58) Field of Search ..... 165/8, 9, 10, 72, 165/73, 77

(56) References Cited

U.S. PATENT DOCUMENTS 2,717,766 A * 9/1955 Becker ..... 165/77
3,416,596 A * 12/1968 Oldehaver ..... 165/10
3,799,241 A * 3/1974 Schluter et al. ..... 165/10
3,874,442 A * 4/1975 Johnsson ..... 165/10
6,035,926 A * 3/2000 Westerlund ..... 165/8
6,328,094 B1 * 12/2000 Mori et al. ..... 165/8
6,260,606 B1 * 7/2001 Fierle et al. ..... 165/8
6,260,607 B1 * 7/2001 Finnemore ..... 165/8

* cited by examiner

*Primary Examiner*—Henry Bennett
*Assistant Examiner*—Terrell McKinnon
(74) *Attorney, Agent, or Firm*—Alix, Yale & Ristas, LLP

(57) ABSTRACT

A combined door and platform assembly for an air preheater having a housing with an access opening. The assembly includes a door frame which is fixedly mounted to the outer surface of the housing around the access opening. The bottom portion of a base is permanently, pivotally mounted to the door frame. The base is moveable from a vertical position, where the base acts as a door closing the access opening, to a horizontal position, where the base acts as a platform to facilitate removal and replacement of basketed materials disposed within the housing.

18 Claims, 5 Drawing Sheets

COMBINED BASKET REMOVAL DOOR AND PLATFORM FOR AIR PREHEATERS

BACKGROUND OF THE INVENTION

The present invention relates generally to rotary heat exchangers and, more specifically, to an integrated means for removing and replacing basketed material within duct work or an air preheater rotor.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality of sector-shaped compartments by a plurality of radial partitions, known as diaphragms, extending from the rotor post to the outer peripheral shell of the rotor. These sector shaped compartments are loaded with modular heat exchange baskets which contain the mass of heat absorbent material commonly comprised of stacked plate-like elements.

Conventional heat exchange baskets may be loaded axially into the rotor from the top end (duct end) or radially through the side of the rotor. Both designs require the positioning of the heavy, bulky heat exchange baskets. The conventional method for removing and replacing radially loaded heat exchange baskets is time consuming and requires the following:

1) The basket removal door is removed and stored.

2) A platform is retrieved from storage and mounted to a pair of columns positioned on either side of the basket removal door opening in the air preheater housing.

3) The heat exchange baskets are pulled from the air preheater onto the platform, lifted off of the platform, and removed from the area.

4) New baskets are placed on the platform and slid into the rotor.

5) The platform is removed and stored in a remote location.

6) The basket removal door is retrieved from storage and reinstalled.

Although the conventional basket installation/removal platform is functionally a good design, it is large and heavy, requiring a crane for installation and removal. Since the heat transfer matrix in the air preheater is long lasting (in many cases having a lifetime of over 5 years) the platform is not a commonly used maintenance item and generally must be stored away from the air preheater. The size and weight of the platform makes transporting the platform to and from storage a difficult task. In addition, the basket removal door must be completely removed and stored during the basket installation/removal process.

SUMMARY OF THE INVENTION

The present invention relates to a combined door and platform assembly for an air preheater having a housing with an access opening. The assembly includes a door frame which is fixedly mounted to the outer surface of the housing around the access opening. The bottom portion of a base is permanently, pivotally mounted to the door frame. The base is moveable from a vertical position, where the base acts as a door closing the access opening, to a horizontal position, where the base acts as a platform to facilitate removal and replacement of basketed materials disposed within the housing.

A pair of side safety panels are pivotally mounted to the sides of the base and an end safety panel is pivotally mounted to the free end of the base. Each of the safety panels is moveable between an extended position, where the safety panel extends substantially perpendicularly from the base, and a storage position, where the safety panel is disposed adjacent the base. The assembly includes stops preventing movement of the safety panels past the extended position and locks selectively holding the safety panels in the extended position. Each safety panel includes multiple posts, at least one hand rail mounted to the posts, and a kick board mounted to the bottom end portions of the posts. The kick board or the bottom end portions of the posts are pivotally mounted to the base.

Preferably, a pair of braces connect the side edges of the base to the side members of the door frame and thereby provide additional mechanical support to the base. Apparatus is provided to lock the base in the vertical position during operation of the air preheater.

DESCRIPTION OF THE PREFERRED EMBODIMENT

Figure 1:
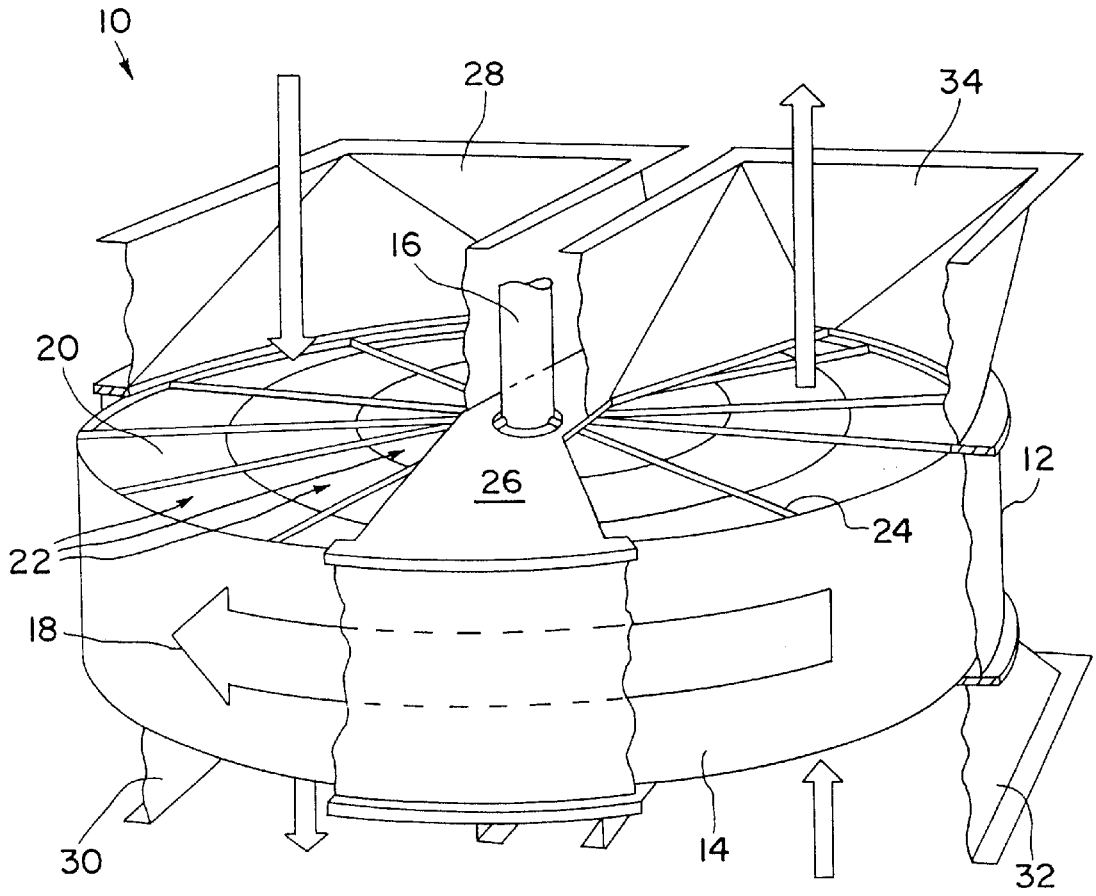
FIG. 1 is a general perspective view of a rotary regenerative air preheater.

FIG. 1 of the drawings is a partially cut-away perspective view of a typical air preheater 10 showing a housing 12 in which the rotor 14 is mounted on drive shaft or post 16 for rotation as indicated by the arrow 18. The rotor is composed of a plurality of sectors 20 with each sector containing a number of heat exchange baskets 22 and with each sector being defined by the diaphragms 24. The heat exchange baskets 22 contain the heat exchange surface. The housing 12 is divided by means of the flow impervious sector plate 26 into a flue gas side and an air side. A corresponding sector plate is also located on the bottom of the unit. The hot flue gases enter the air heater through the gas inlet duct 28, flow through the rotor where heat is transferred to the rotor and then exit through gas outlet duct 30. The countercurrent flowing air enters through air inlet duct 32, flows through the rotor where it picks up heat and then exits through air outlet duct 34.

Figure 2:
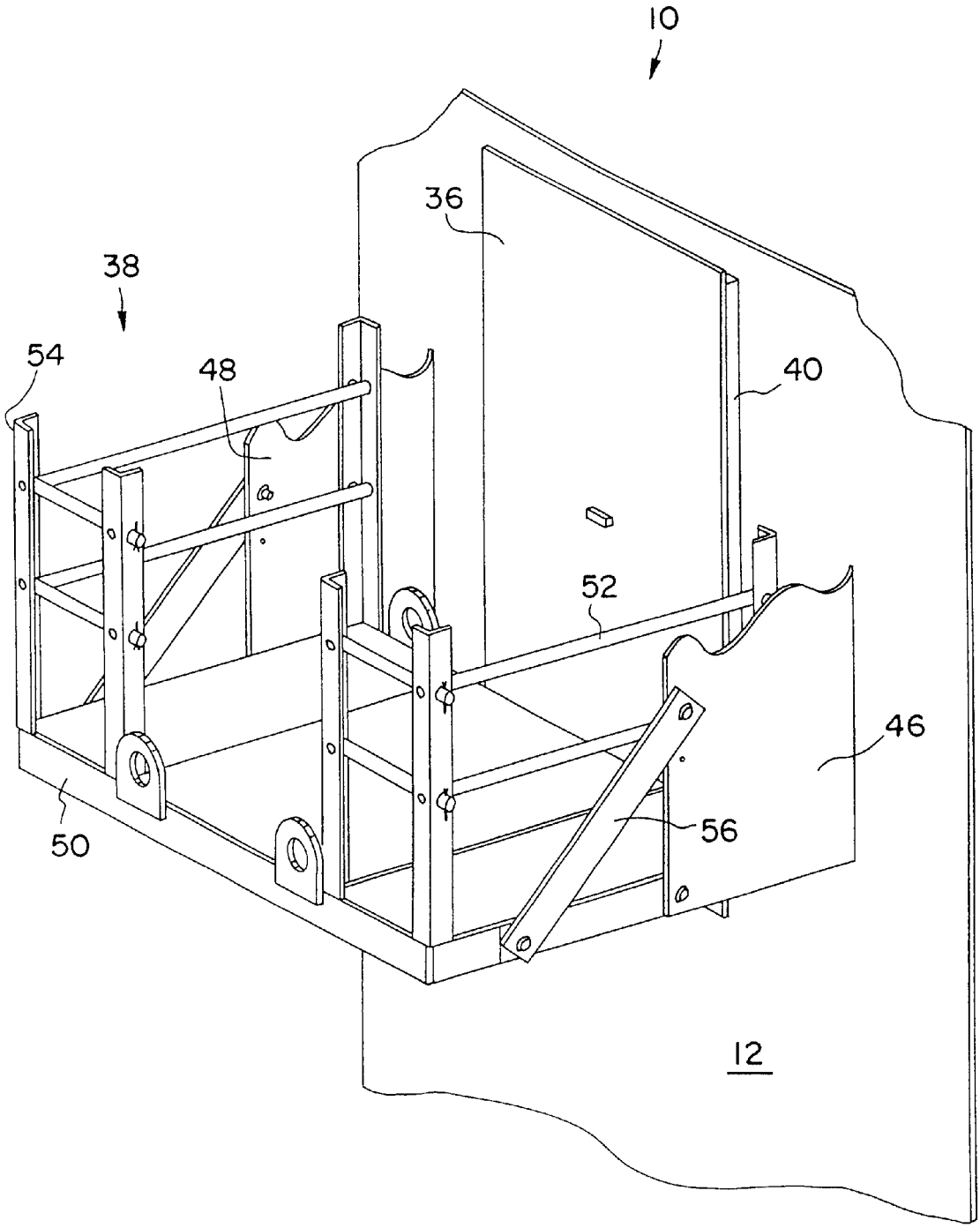
FIG. 2 PRIOR ART
FIG. 2 is a schematic perspective view of an air preheater housing having a conventional basket access door and a conventional platform.
Figure 3:
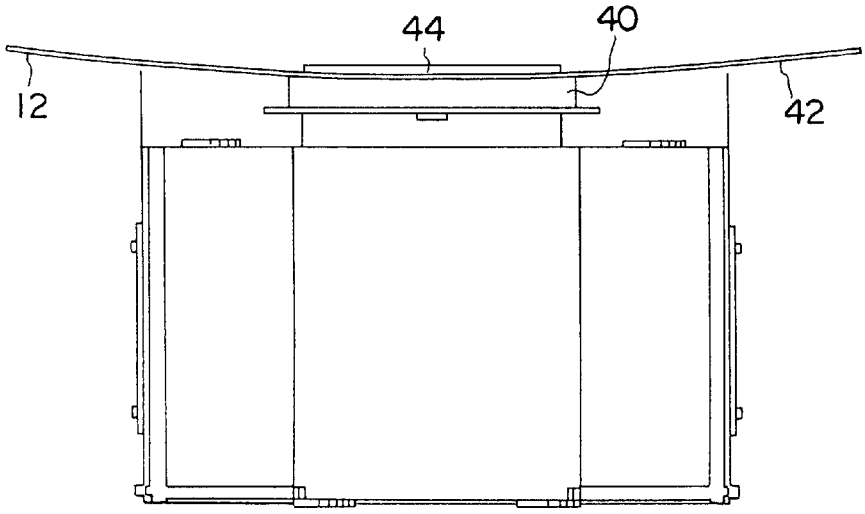
FIG. 3 PRIOR ART
FIG. 3 is a top view of the air preheater housing, conventional basket access door, and conventional platform of FIG. 2.
Figure 4:
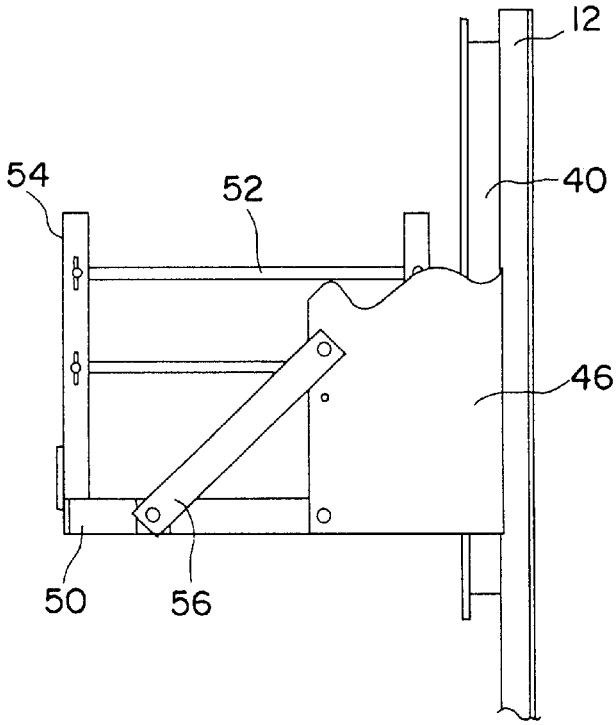
FIG. 4 PRIOR ART
FIG. 4 is a side view of the air preheater housing, conventional basket access door and conventional platform of FIG. 2.
Figure 5:
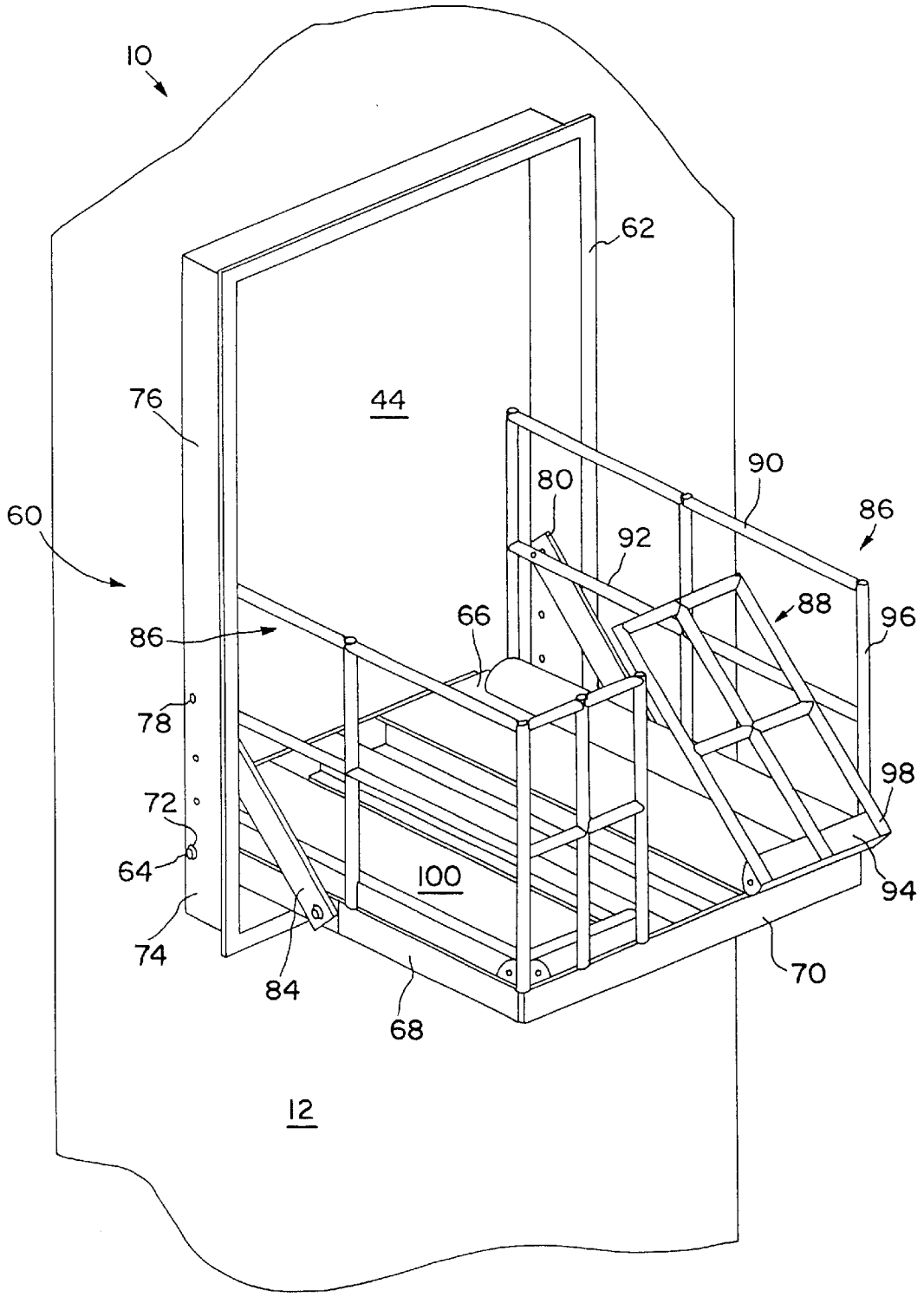
FIG. 5 is a schematic perspective view of an air preheater housing and a combined basket access door and platform in accordance with the invention.
Figure 6:
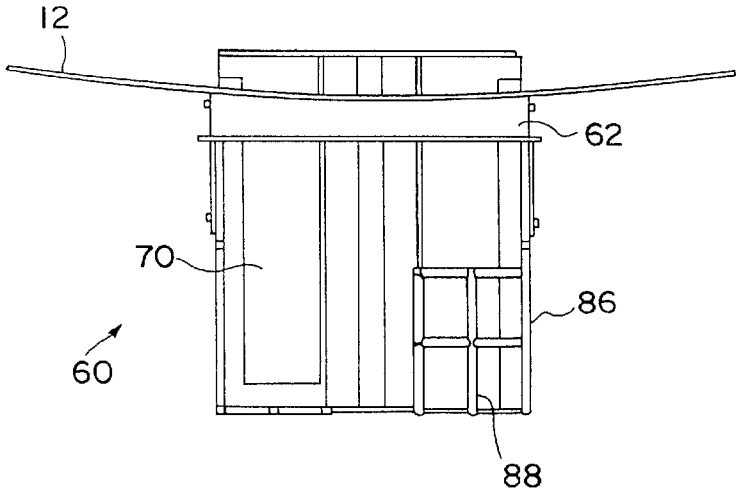
FIG. 6 is a top view of the air preheater housing and combined basket access door and platform of FIG. 5.
Figure 7:
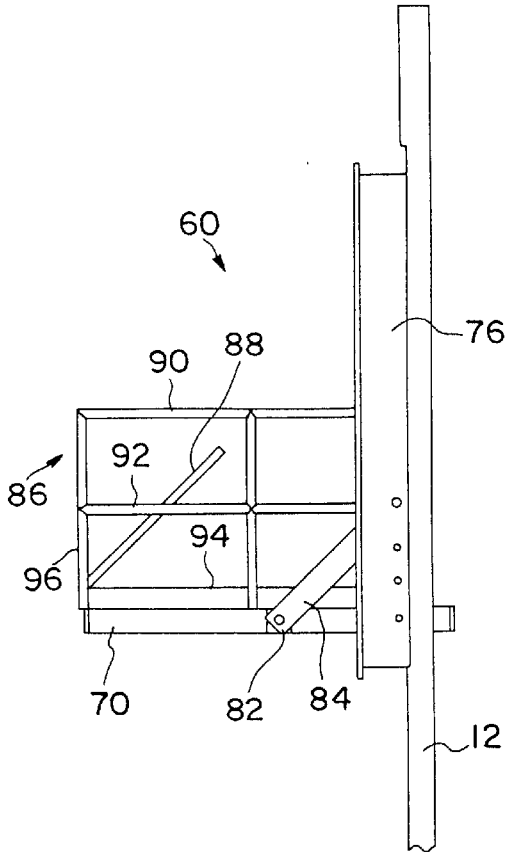
FIG. 7 is a side view of the air preheater housing and combined basket access door and platform of FIG. 5.

FIGS. 2, 3, and 4 illustrate a conventional basket access door 36 and conventional platform 38 mounted to the housing 12 of an air preheater 10. The conventional basket access door 36 is removably mounted to a door frame 40 which is permanently affixed to the outer surface 42 of the housing 12 around a basket access opening 44. First and second columns 46, 48 are vertically mounted on either side of the door frame 40.

The conventional basket removal platform 38 includes a platform base 50, safety hand rails 52, and safety posts 54 mounting the hand rails 52 to the platform base 50. The door 36 is dismounted from the door frame 40 and put into storage for the duration of the basket transfer procedure. The basket removal platform 38 is retrieved from storage and mounted to the air preheater housing 12 by temporarily mounting the inner platform safety posts 54 and the platform base 50 to the columns 46, 48. A pair of support bars 56 mounted to platform base 50 and the columns 46, 48 provide additional support to the platform base 50.

The combined basket access door and platform comprises a platform/door assembly 60 which is permanently mounted to the air preheater housing 12, eliminating the basket access door removal, storage, retrieval, and reinstallation tasks and the basket removal platform retrieval, installation, removal, and storage tasks that are conventionally required to allow the transfer of heat exchange baskets 22. The platform/door assembly 60 includes a door frame 62 which is permanently mounted to the outer surface 42 of the housing 12 around the basket access opening 44. Pivot pins 64 fixedly mounted to the bottom portion 66 of the oppositely disposed outside edges 68 of the platform/door base 70 are received in openings 72 in the lower end portions 74 of each side member 76 of the door frame 62 to pivotally mount the bottom portion 66 of the platform/door base 70 to the door frame 62.

During normal operation, openings 78 in the side members 76 of the door frame 62 and the outside edges 68 of the platform/door base 70 receive bolts (not shown) to secure the platform/door base 70 in a first, vertical position, where the platform/door base 70 acts as a door to close the basket access opening 44. The platform/door base 70 may be unbolted from the frame 62 and pivotally moved to a second, horizontal position, where the platform/door base 70 acts as a basket removal platform. Upper and lower end portions 80, 82 of a pair of diagonal braces 84 are mounted to the side members 76 of the door frame 62 and the outside edges 68 of the platform/door base 70, respectively, to provide additional support to the platform/door base 70.

A pair of side safety panels 86 and at least one end safety panel 88 fold up to form safety hand rails during basket transfer operations and fold down for storage, allowing the platform/door base 70 to be moved to the vertical position. Each safety panel 86, 88 includes an upper hand rail 90, an intermediate hand rail 92, and a kick board 94 which are mounted to two or more posts 96. The kick board 94 and/or the bottom end portions 98 of the posts 96 are pivotally mounted to the platform/door base 70. Each safety panel 86, 88 is pivotally moveable from an extended position, where the safety panel 86, 88 extends substantially perpendicularly from the platform/door base 70, to a storage position, where the safety panel 86, 88 is disposed adjacent the inner surface 100 of the platform/door base 70.

Preferably, the platform/door assembly 60 includes apparatus for limiting the pivotal movement of each safety panel 86, 88 such that the safety panels 86, 88 may not be pivoted past the extended position. For example, the platform/door base 70 may include an upwardly extending lip which engages the kick board 94 and/or the bottom end portions 98 of the posts 96 when the safety panel 86, 88 is in the extended position. The platform/door assembly 60 also preferably includes apparatus for locking each safety panel 86, 88 in both the extended position and the storage position. For example, spring-loaded detents mounted to one of the safety panel 86, 88 or platform/door base 70 may be received in an aperture in the other of the platform/door base 70 or safety panel 86, 88 when the safety panel 86, 88 is in either position.

The combined basket access door and platform is a unique solution for the installation and removal of heat exchange baskets 22 from the air preheater 10. The combined basket access door and platform eliminates the need for storage space for the platform while continuing to provide the same functionality of the externally mounted platform design.

I claim:

1. A door and platform assembly for an air preheater including a housing having an outer surface and an access opening, the assembly comprising:

a door frame adapted for fixedly mounting to the outer surface of the housing surrounding the access opening;

a base having oppositely disposed first and second sides and oppositely disposed first and second ends, the first end being permanently, pivotally mounted to the door frame, the base being moveable between a closed position, wherein the base defines a door closing the access opening, and an open position, wherein the base defines a platform extending horizontally from the door frame to the second end; and first and second side safety panels pivotally mounted to the first and second sides of the base, respectively, and an end safety panel pivotally mounted to the second end of the base, each of the safety panels being moveable between an extended position, wherein the safety panel extends substantially perpendicularly from the base, and a storage position, wherein the safety panel is disposed adjacent the base.

2. The assembly of claim 1 wherein each safety panel includes a stop preventing movement of the safety panel past the extended position.

3. The assembly of claim 1 wherein each safety panel includes a lock selectively holding the safety panel in the extended position.

4. A door and platform assembly for removal and replacement of basketed materials from an air preheater including a housing having an outer surface and a basket access opening, the assembly comprising:

a door frame adapted for fixedly mounting to the outer surface of the housing around the basket access opening;

a base permanently mounted to the door frame, the base having a periphery and being pivotally moveable between a closed position, wherein the base defines a door closing the basket access opening, and an open position, wherein the base defines a platform; and a plurality of safety panels mounted to the base adjacent to the periphery of the base, each of the safety panels being pivotally moveable between an extended position, wherein the safety panel extends substantially perpendicularly from the base, and a storage position, wherein the safety panel is disposed adjacent the base.

5. The assembly of claim 4 wherein each safety panel includes a plurality of posts, at least one hand rail, and a kick board, each of the posts having a bottom end portion, the hand rail being mounted to the posts, and the kick board being mounted to the bottom end portions of the posts, the kick board or the bottom end portions of the posts being pivotally mounted to the base.

6. The assembly of claim 4 wherein each safety panel includes a stop preventing movement of the safety panel past the extended position and a lock selectively holding the safety panel in the extended position.

7. The assembly of claim 4 further comprising at least one brace connecting the base to the door frame and supporting the base thereon.

8. A combined door and platform assembly for removal and replacement of basketed materials from an air preheater including a housing having an outer surface and a basket access opening, the assembly comprising:

a door frame adapted for fixedly mounting to the outer surface of the housing around the basket access opening; and a base having a bottom portion permanently pivotally mounted to the door frame, the base being pivotally moveable from a vertical position, wherein the base defines a door closing the basket access opening, to a horizontal position, wherein the base defines a platform.

9. The assembly of claim 8 wherein the base also has first and second, oppositely disposed side edges and the door frame includes first and second, oppositely disposed side members, each of the side members having a lower end portion, first and second side edges of the base being pivotally mounted to the lower end portions of the first and second side members of the door frame, respectively.

10. The assembly of claim 9 wherein the lower end portions of each side member of the door frame defines an opening and the base further has first and second pivot pins mounted to the first and second side edges, respectively, at the bottom portion of the base, the first and second pivot pins being received in the openings of the first and second side members, respectively, to pivotally mount the base to the door frame.

11. The assembly of claim 8 further comprising means for securing the base in the vertical position.

12. The assembly of claim 8 further comprising first and second braces, the base also having first and second, oppositely disposed side edges and the door frame including first and second, oppositely disposed side members, the first and second braces being mounted to the first and second side members of the door frame and the first and second side edges of the base.

13. The assembly of claim 8 further comprising at least one safety panel, each safety panel having a lower end portion pivotally mounted to the base and being pivotally moveable between an extended position, wherein the safety panel extends substantially perpendicularly from the base, to a storage position, wherein the safety panel is disposed adjacent the base.

14. The assembly of claim 13 wherein each safety panel includes a plurality of posts and at least one hand rail mounted to the posts.

15. The assembly of claim 14 wherein each post has a bottom end portion and each safety panel also includes a kick board mounted to the bottom end portions of the posts, the kick board or the bottom end portions of the posts being pivotally mounted to the base.

16. The assembly of claim 13 further comprising means for limiting pivotal movement of each safety panel whereby the safety panel may not be pivoted past the extended position.

17. The assembly of claim 16 wherein the base also has an orthogonally extending lip defining the means for limiting pivotal movement, the lip engaging the safety panel when the safety panel is in the extended position.

18. The assembly of claim 13 further comprising means for locking each safety panel in the extended position.

* * * * *